US007294237B2

(12) United States Patent
Herman et al.

(10) Patent No.: US 7,294,237 B2
(45) Date of Patent: Nov. 13, 2007

(54) PRESS SECTION AND PERMEABLE BELT IN A PAPER MACHINE

(75) Inventors: Jeffrey Herman, Bala Cynwyld, PA (US); Thomas Thoröe Scherb, Sao Paulo (BR); Luiz Carlos Silva, Campo Limpo (BR)

(73) Assignee: Voith Paper Patent GmbH, Heidenheim (DE)

( * ) Notice: Subject to any disclaimer, the term of this patent is extended or adjusted under 35 U.S.C. 154(b) by 500 days.

(21) Appl. No.: 10/768,485

(22) Filed: Jan. 30, 2004

(65) Prior Publication Data

US 2005/0167068 A1 Aug. 4, 2005

(51) Int. Cl.
*D21F 3/02* (2006.01)
*B32B 5/04* (2006.01)

(52) U.S. Cl. ..... 162/358.3; 162/358.1; 162/358.2; 162/358.4; 100/153

(58) Field of Classification Search ..... 162/358.1, 162/358.2, 358.3, 358.4, 204–207, 116, 117, 162/306, 348, 360.3, 359.1, 900–903; 139/383 A, 139/425 A; 442/270, 271, 286, 320; 100/121, 100/37, 151–154; 428/222
See application file for complete search history.

(56) References Cited

U.S. PATENT DOCUMENTS

| | | | | |
|---|---|---|---|---|
| 3,293,121 | A * | 12/1966 | Martin | 162/358.3 |
| 3,399,111 | A * | 8/1968 | Beaumont et al. | 162/199 |
| 3,797,384 | A * | 3/1974 | Hoff | 100/154 |
| 3,798,121 | A * | 3/1974 | Busker | 162/205 |
| 3,974,026 | A * | 8/1976 | Emson et al. | 162/358.3 |
| 4,431,045 | A * | 2/1984 | Josefsson | 162/358.3 |
| 4,464,226 | A * | 8/1984 | Karvinen | 162/358.3 |
| 4,496,429 | A * | 1/1985 | Salminen et al. | 162/358.4 |
| 4,564,551 | A * | 1/1986 | Best | 428/222 |
| 4,948,467 | A * | 8/1990 | Creagan | 162/358.3 |
| 6,436,240 | B1 * | 8/2002 | Jeffrey | 162/358.2 |
| 6,514,382 | B1 | 2/2003 | Kakiiuchi et al. | 162/109 |
| 6,616,812 | B2 * | 9/2003 | Beck | 162/358.2 |
| 6,780,282 | B2 * | 8/2004 | Scherb et al. | 162/111 |
| 2003/0056925 | A1 | 3/2003 | Beck | 162/358.1 |
| 2003/0136018 | A1 | 7/2003 | Herman et al. | 34/114 |

FOREIGN PATENT DOCUMENTS

| | | |
|---|---|---|
| DE | 37 28 124 | 3/1989 |
| DE | 198 45 954 | 4/2000 |
| DE | 199 46 979 | 4/2001 |

* cited by examiner

*Primary Examiner*—Eric Hug
(74) *Attorney, Agent, or Firm*—Taylor & Aust, P.C.

(57) ABSTRACT

A belt press including a roll having an exterior surface and a permeable belt having a side in pressing contact over a portion of the exterior surface of the roll. The permeable belt having a tension of at least 30 KN/m applied thereto. The side of the permeable belt having an open area of at least approximately 25%, and a contact area of at least approximately 25%.

30 Claims, 7 Drawing Sheets

PRESS SECTION AND PERMEABLE BELT IN A PAPER MACHINE

BACKGROUND OF THE INVENTION

1. Field of the Invention

The present invention relates to a paper machine, and, more particularly, to a permeable belt used in a belt press in a paper machine.

2. Description of the Related Art

In a wet pressing operation a fibrous web sheet is compressed at a press nip to the point where hydraulic pressure drives water out of the fibrous web. It has been recognized that conventional wet pressing methods are inefficient in that only a small portion of a rollers circumference is used to process the paper web. To overcome this limitation, some attempts have been made to adapt a solid impermeable belt to form an extended nip for pressing the paper web to dewater the paper web. A problem with such an approach is that the impermeable belt prevents the flow of a drying fluid, such as air through the paper web. Extended nip presses (ENP) belts are used throughout the paper industry as a way of increasing the actual pressing dwell time in a press nip. A shoe press is the apparatus that provides the ability of the ENP belt to have pressure applied therethrough, by having a stationary shoe that is configured to the curvature of the hard surface being pressed, for example, a solid press roll. In this way the nip can be extended well beyond the limit of the contact between the press rolls themselves. An ENP belt serves as a roll cover on the shoe press. This flexible belt is lubricated on the inside to prevent frictional damage. The belt and shoe press are non-permeable members and dewatering of the fibrous web is accomplished by the mechanical pressing thereof.

What is needed in the art is a belt, which provides enhanced dewatering of a continuous web.

SUMMARY OF THE INVENTION

The present invention provides a high strength permeable press belt with open areas and contact areas on a side of the belt.

The invention comprises, in one form thereof, a belt press including a roll having an exterior surface and a permeable belt having a side in pressing contact over a portion of the exterior surface of the roll. The permeable belt having a tension of at least 30 KN/m applied thereto. The side of the permeable belt having an open area of at least approximately 25%, and a contact area of at least approximately 25%.

An advantage of the present invention is that it allows substantial airflow therethrough to reach the fibrous web for the removal of water by way of a vacuum, particularly during a pressing operation.

Another advantage is that the permeable belt allows a significant tension to be applied thereto.

Yet another advantage is that the permeable belt has substantial open areas adjacent to contact areas along one side of the belt.

Still yet another advantage of the present invention is that the permeable belt is capable of applying a line force over an extremely long nip, thereby ensuring a long dwell time in which pressure is applied against the web as compared to a standard shoe press.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
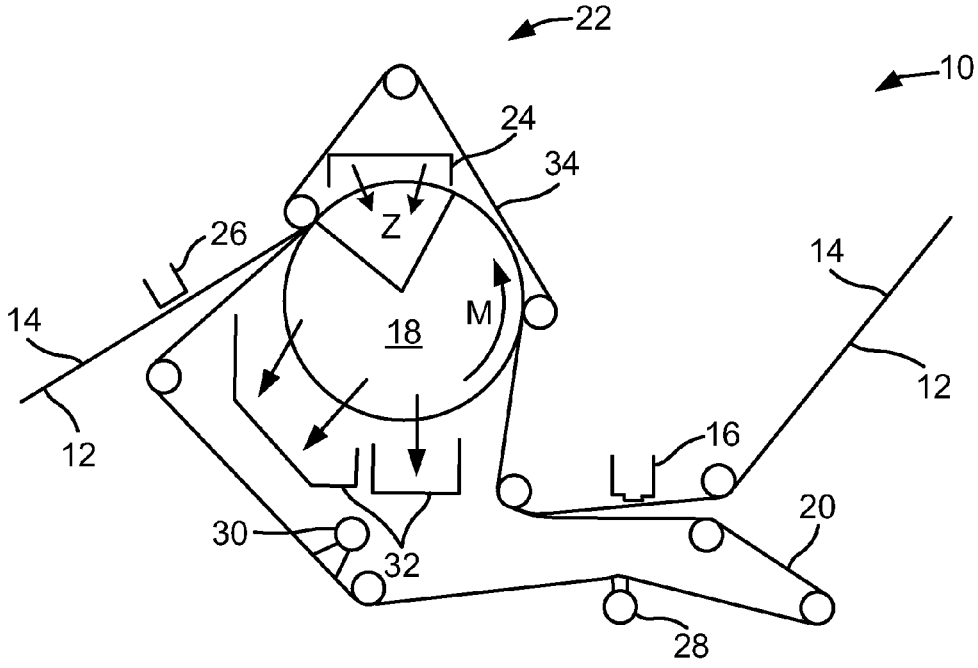
FIG. 1 is a cross-sectional schematical diagram of an advanced dewatering system with an embodiment of a belt press of the present invention.
Figure 2:
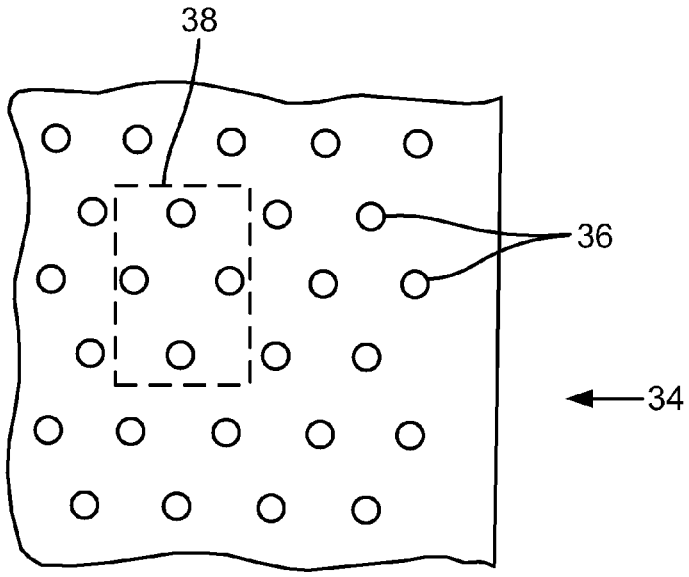
FIG. 2 is a surface view of one side of a permeable belt of the belt press of FIG. 1.

Referring now to the drawings, and more particularly to FIG. 1, there is shown an advanced dewatering system 10 for the processing of fibrous web 12. System 10 includes a fabric 14, suction box 16, a vacuum roll 18, a dewatering fabric 20, a belt press assembly 22, a hood 24, a pick up suction box 26, Uhle box 28, showers 30 and save alls 32. Fibrous web 12 enters system 10 generally from the right as shown in FIG. 1. Fibrous web 12 is previously formed into a web by a mechanism not shown.

Fibrous web 12 is moved by fabric 14 past suction box 16. At vacuum box 16 sufficient moisture is removed from web 12 to achieve a solids level of between 15% and 25% on a typical 20 gram per square meter web (gsm) running at −0.2 to −0.8 bar vacuum, with a preferred operating level of −0.4 to −0.6 bar.

As fibrous web 12 proceeds in the machine direction it comes into contact with dewatering fabric 20. Web 12 then proceeds toward vacuum roll 18 between fabric 14 and dewatering fabric 20. Vacuum roll 18 is operated at a vacuum level of −0.2 to −0.8 bar with a preferred operating level of at least −0.4 bar. Fabric 14, web 12 and fabric 20 are engaged against vacuum roll 18 by belt press 22.

Now, additionally referring to FIGS. 2-5 there is shown details of permeable belt 34 of belt press 22 having holes 36 therethrough, holes 36 arranged in a hole pattern 38 and grooves 40 in one side of belt 34. Permeable belt 34 is routed so as to engage a surface of fabric 14 and thereby press fabric 14 further against web 12, and web 12 against fabric 20, which is supported thereunder by vacuum roll 18. As this temporary coupling around vacuum roll 18 continues in machine direction M, it encounters a vacuum zone Z through which air is passed from hood 24 through permeable belt 34, fabric 14, drying web 12 and the moisture picked up by the air flow proceeds further through fabric 20 and through a porous surface of vacuum roll 18. As such, web 12 experiences both pressing and airflow in a simultaneous manner. Moisture directed into vacuum roll 18 mainly exits by way of a vacuum system. Some of the moisture from the surface of roll 18 is captured by save alls 32 located beneath vacuum roll 18. As web 12 leaves belt press 22, fabric 20 is separated from web 12, and web 12 continues with fabric 14 past pick up vacuum 26, which additionally suctions moisture from fabric 14 and web 12 and stabilizes web 12.

Fabric 20 proceeds past showers 30, which apply moisture to fabric 20 to clean fabric 20. Fabric 20 then proceeds past Uhle box 28, which removes moisture from fabric 20.

If fabric 14 is a structured fabric 14, having a three dimensional structure that is reflected in web 12, thicker pillow areas of web 12 are formed. The pillow areas are protected during pressing as they are within the body of structured fabric 14. As such the pressing imparted by belt press assembly 22 upon web 12 does not negatively impact web quality, while it increases the dewatering rate of vacuum roll 18. In a No Press/Low Press apparatus the pressure is transmitted through a dewatering fabric, also known as a press fabric. In such a case web 12 is not protected inside structured fabric 14. This is still advantageous, because the press nip is much longer than a conventional press, which results in a lower specific pressure and less compaction of web 12.

Now, additionally referring to FIGS. 6-11, there is further illustrated embodiments of permeable belt 34, used in belt press 22, that may be an extended nip press belt 34 made of a flexible reinforced polyurethane 42 and/or a spiral link fabric 48. Permeable belt 34 provides a low level of pressing in the range of 50-300 KPa and preferably greater than 100 KPa. This allows a suction roll with a 1.2 meter diameter to have a fabric tension of greater than 30 KN/m and preferably greater than 60 KN/m. The pressing length of permeable belt 34 against fabric 14, which is indirectly supported by vacuum roll 18, is at least as long as suction zone Z in roll 18. Although the contact portion of permeable belt 34 can be shorter than suction zone Z.

Figure 3:
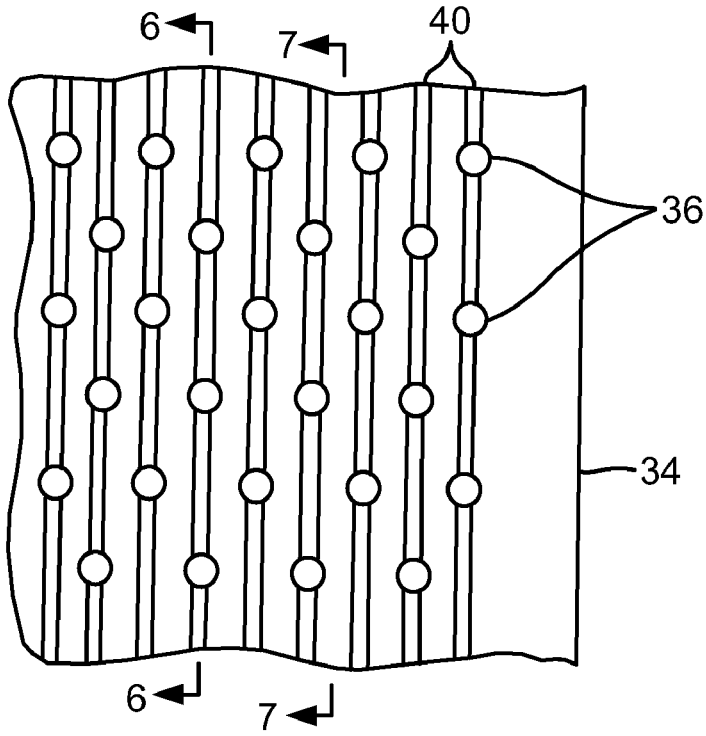
FIG. 3 is a view of an opposite side of the permeable belt of FIG. 2.
Figure 4:
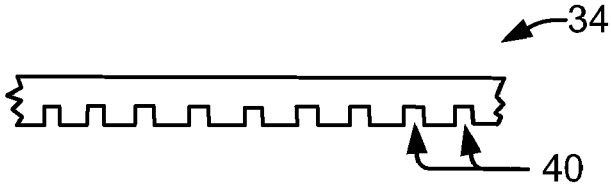
FIG. 4 is cross-sectional view of the permeable belt of FIGS. 2 and 3.
Figure 5:
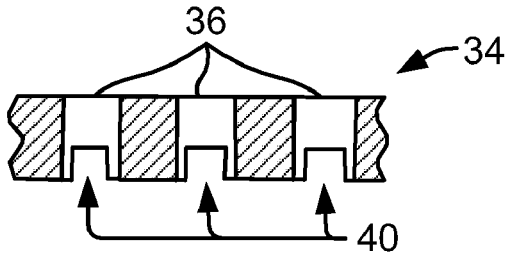
FIG. 5 is an enlarged cross-sectional view of the permeable belt of FIGS. 2-4.

Permeable belt 34 has a pattern 38 of holes 36 therethrough, which may, for example, be drilled, laser cut, etched formed or woven therein. Permeable belt 34 may be monoplanar without the grooves shown in FIGS. 3-5. In one embodiment of the present invention, the surface having grooves 40 as shown in FIG. 3 is placed in contact with fabric 14 along a portion of the travel of permeable belt 34 in belt press 22. Each groove 40 connects with a set of holes 36 to allow the passage and distribution of air in belt 34. Air is distributed along grooves 40, which constitutes an open area adjacent to contact areas, where the surface of belt 34 applies pressure against web 12. Air enters permeable belt 34 through holes 36 and then migrates along grooves 40 passing through fabric 14, web 12 and fabric 20. The diameter of holes 36 is larger than the width of grooves 40. Although grooves 40 are shown having a generally rectangular cross-sectional, grooves 40 may have a different cross-section contour, such as, triangular, trapezoidal, semicircular or semi-elliptical. The combination of permeable belt 34, associated with vacuum roll 18, is a combination that has been shown to increase sheet solids by at least 15%.

Figure 6:
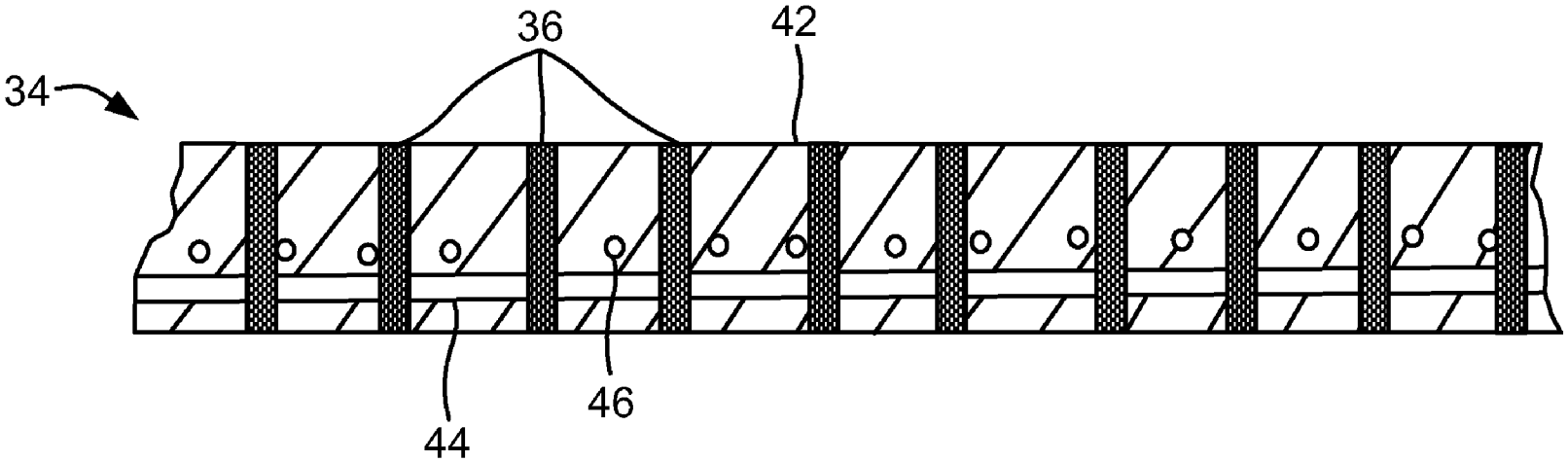
FIG. 6 is a cross-sectional view of the permeable belt of FIG. 3 along section line 6-6.
Figure 7:
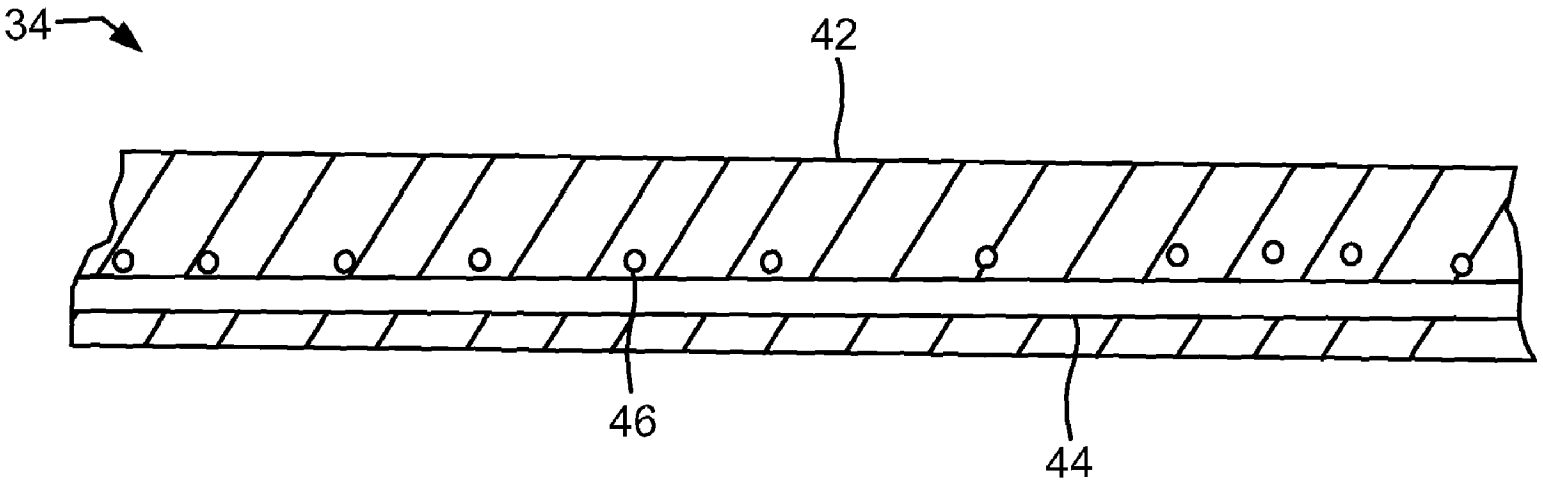
FIG. 7 is a cross-sectional view of the permeable belt of FIG. 3 along section line 7-7.

In one embodiment of permeable belt 34, as illustrated in FIGS. 6 and 7, a polyurethane matrix 42 has a permeable structure in the form of a woven structure with reinforcing machine direction yarns 44 and cross direction yarns 46 at least partially embedded within polyurethane matrix 42.

Figure 8:
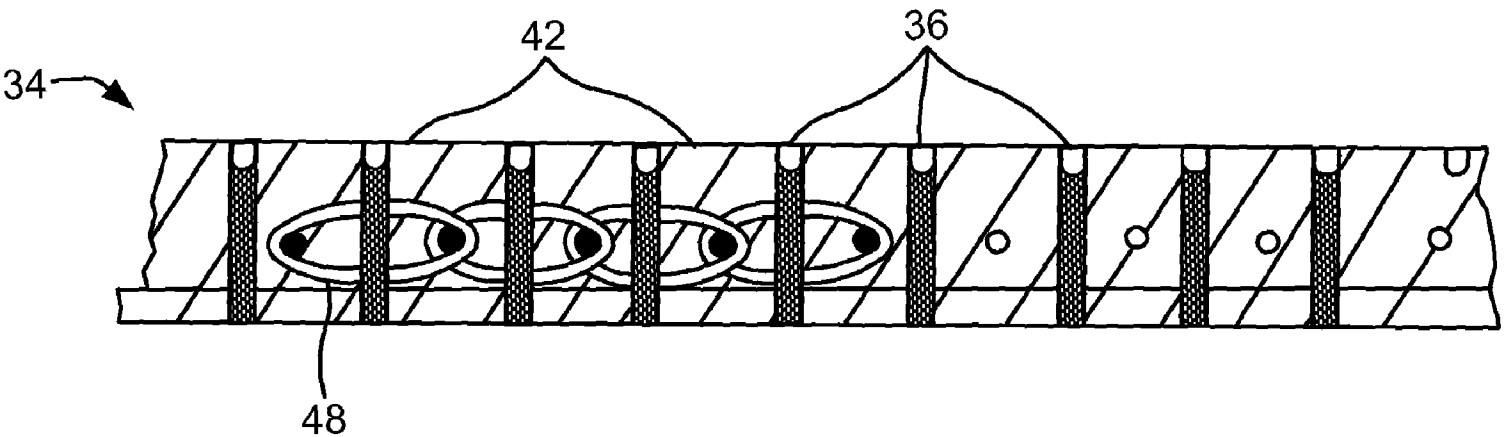
FIG. 8 is a cross-sectional view of another embodiment of the permeable belt of FIG. 3 along section line 6-6.
Figure 9:
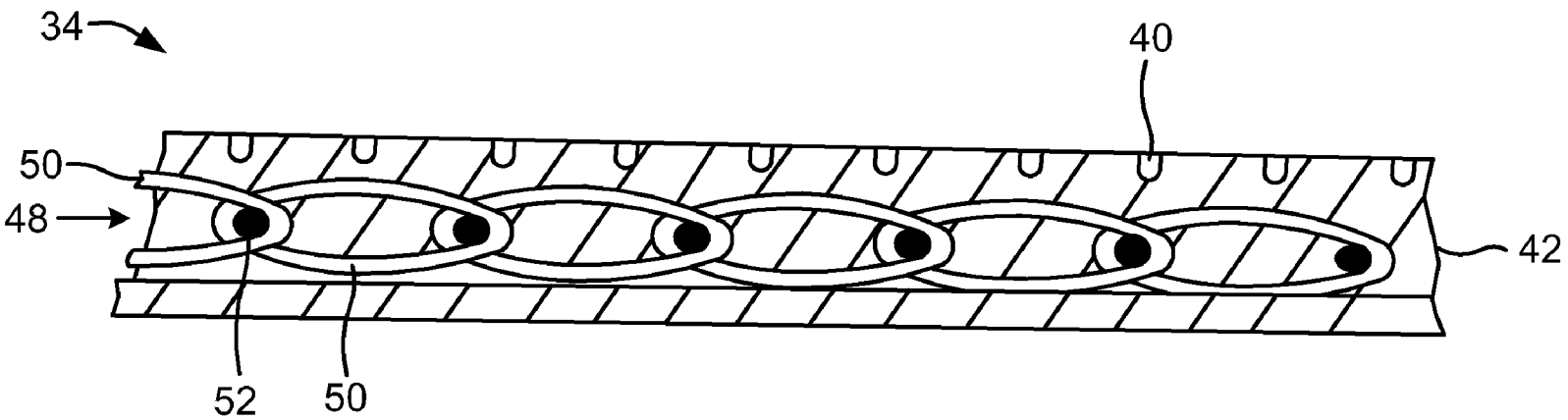
FIG. 9 is a cross-sectional view of another embodiment of the permeable belt of FIG. 3 along section line 7-7.

In another embodiment of permeable belt 34, as illustrated in FIGS. 8 and 9, a polyurethane matrix 42 has a permeable structure in the form of a spiral link fabric 48 at least partially embedded within polyurethane matrix 42. Holes 36 extend through belt 34 an may at least partially sever portions of spiral link fabric 48.

Figure 10:
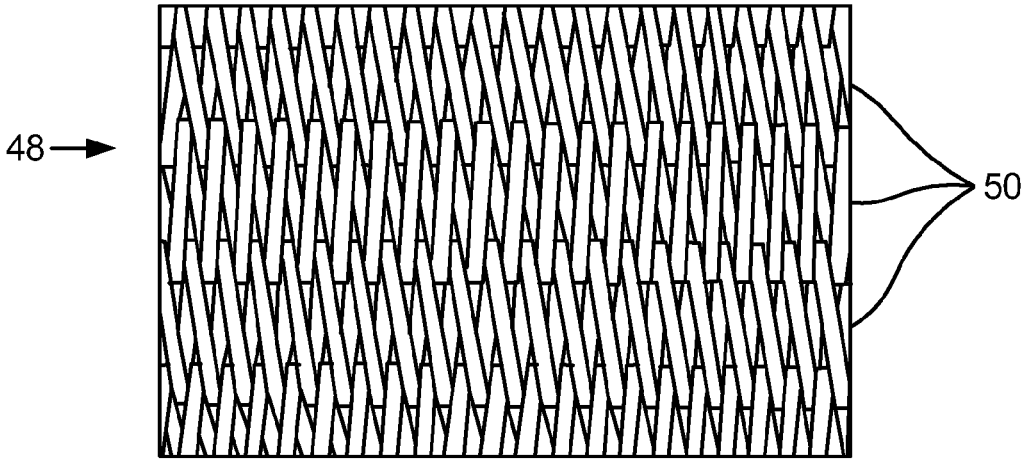
FIG. 10 is a surface view of another embodiment of the permeable belt of the present invention.
Figure 11:
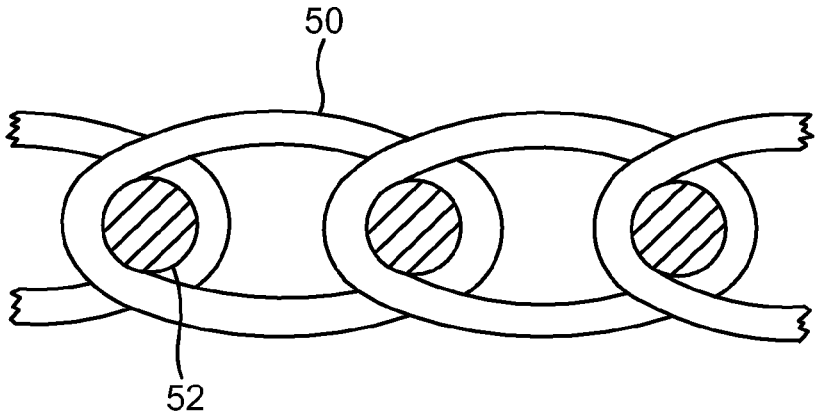
FIG. 11 is a side view of a portion of the permeable belt of FIG. 10.

In yet another embodiment of permeable belt 34, as illustrated in FIGS. 10 and 11, yarns 50 are interlinked by the entwining of generally spiral woven yarns 50 with cross yarns 52 to form link fabric 48.

Permeable belt 34 is capable of running at high running tensions of at least 30 KN/m or 60 KN/m or higher with a surface contact area of 10% or greater and an open area of 15% or greater. The contact may be 25% or greater and the open area of 25% or greater. Preferably permeable belt 34 will have an open area of at least 50%, and even more preferably an open area of at least 70%. More preferably, permeable belt 34 has an open area of between 15% and 50%, and a contact area of between 50% and 85%. The composition of permeable belt 34 may include a thin spiral link having a support layer within permeable belt 34. Further, permeable belt 34 may be a spiral link fabric 34 having a contact area of between 10% and 40%, and an open area of between 60% to 90%.

The circumferential length of vacuum zone Z can be from 200 mm to 2500 mm, with a preferable length of 300 mm-1200 mm, and an even more preferable length of 400 mm-800 mm. The solids leaving vacuum roll 18 in web 12 will vary between 25% to 55% depending on the vacuum pressures and the tension on permeable belt as well as the length of vacuum zone Z and the dwell time of web 12 in vacuum zone Z. The dwell time of web 12 in vacuum zone Z is sufficient to result in this solids range of 25% to 55%.

Permeable belt 34 is capable of applying a line force over an extremely long nip, thereby ensuring a long dwell time in which pressure is applied against web 12 as compared to a standard shoe press. This results in a much lower specific pressure, thereby reducing the sheet compaction and enhancing sheet quality. The present invention further allows for a simultaneous vacuum and pressing dewatering with airflow through the web at the nip itself.

Advanced dewatering system 10 utilizes belt press 22 to remove water from web 12, which is formed prior to reaching belt press 22. Permeable belt 34 is routed in belt press 22 so as to engage a surface of fabric 14 and thereby press fabric 14 further against web 12, and web 12 against fabric 20, which is supported thereunder by vacuum roll 18. The physical pressure applied by belt 34 places some hydraulic pressure on the water in web 12 causing it to migrate toward fabrics 14 and 20. As this coupling of web 12 with fabrics 14 and 20, and belt 34 continues around vacuum roll 18 in machine direction M, it encounters a vacuum zone Z through which air is passed from hood 24 through permeable belt 34, fabric 14, drying web 12 and the moisture picked up by the air flow proceeds further through fabric 20 and through a porous surface of vacuum roll 18. Drying air passes through holes 36 is distributed along grooves 40 before passing through fabric 14. As web 12 leaves belt press 22, belt 34 separates from fabric 14. Shortly thereafter fabric 20 separates from web 12, and web 12 continues with fabric 14 past pick up vacuum 26, which additionally suctions moisture from fabric 14 and web 12.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A belt press in a paper machine, the belt press, comprising:

a roll having an exterior surface; and a permeable belt having a side providing a pressing force over a portion of said exterior surface of said roll, said permeable belt having a tension of at least 30 KN/m, said side having an open area of at least approximately 25%, said side having a contact area of at least approximately 25%.

2. The press of claim 1, wherein said permeable belt has holes therethrough, said holes being in a pattern.

3. The press of claim 2, wherein said belt has a machine direction, said pattern including sets of said plurality of holes aligned in rows in said machine direction.

4. The press of claim 3, wherein said belt additionally includes a plurality of grooves along said side of said fabric belt, each of said grooves intersecting a corresponding set of said plurality of holes.

5. The press of claim 4, wherein said grooves each have a width, and said plurality of holes each have a diameter, said diameter larger than said width.

6. The press of claim 1, wherein said tension of said belt is greater than approximately 60 KN/m.

7. The press of claim 1, wherein said roll is a vacuum roll having an interior circumferential portion.

8. The press of claim 7, wherein said vacuum roll has a vacuum zone applied to said interior circumferential portion.

9. The press of claim 8, wherein said interior circumferential portion is in the range of approximately 200 mm to approximately 2,500 mm.

10. The press of claim 9, wherein said interior circumferential portion is in the range of approximately 300 mm to approximately 1,200 mm.

11. The press of claim 10, wherein said interior circumferential portion is in the range of approximately 400 mm to approximately 800 mm.

12. The press of claim 1, wherein said permeable belt is one of at least a polyurethane extended nip belt and a spiral link fabric.

13. The press of claim 12, wherein said permeable belt is a polyurethane extended nip belt having a plurality of reinforcing yarns embedded therein.

14. The press of claim 12, wherein said plurality of reinforcing yarns include a plurality of machine direction yarns and a plurality of cross direction yarns embedded in said polyurethane extended nip belt.

15. The press of claim 12, wherein said permeable belt is a polyurethane extended nip belt having a plurality of reinforcing yarns embedded therein, said reinforcing yarns woven in a spiral link manner.

16. The press of claim 12, wherein said permeable belt is a spiral link fabric.

17. The press of claim 1, further comprising a first fabric and a second fabric, said first fabric having a first side and a second side, said first side of said first fabric in at least partial contact with said exterior surface of said roll, said second side of said first fabric in at least partial contact with a first side of a fibrous web, said second fabric having a first side and a second side, said first side of said second fabric in at least partial contact with said side of said permeable belt, said second side of said second fabric in at least partial contact with a second side of said fibrous web.

18. An extended nip press belt assembly for use in a fibrous web drying mechanism, comprising:

a permeable belt having a tension of at least 30 KN/m applied thereto, said permeable belt having a side with an open area of at least approximately 15%, said side having a contact area of at least approximately 10%; and a vacuum device having a surface that provides a pressing force against a portion of said permeable belt.

19. The extended nip press belt assembly of claim 18, wherein said open area is between approximately 15% and approximately 50%, said contact area being between approximately 50% and approximately 85%.

20. The extended nip press belt assembly of claim 18, wherein said permeable belt is a spiral link fabric, said open area being between approximately 10% and approximately 40%, said contact area being between approximately 60% and approximately 90%.

21. The extended nip press belt assembly of claim 18, wherein said permeable belt has holes therethrough, said holes being in a pattern.

22. The extended nip press belt assembly of claim 21, wherein said permeable belt has a machine direction, said pattern including sets of said plurality of holes aligned in rows in said machine direction.

23. The extended nip press belt assembly of claim 22, wherein said permeable belt additionally includes a plurality of grooves in said side of said fabric belt, each of said grooves intersecting a corresponding set of said plurality of holes.

24. The extended nip press belt assembly of claim 23, wherein said grooves each have a width, and said plurality of holes each have a diameter, said diameter larger than said width.

25. The extended nip press belt assembly of claim 18, wherein said tension of said permeable belt is greater than approximately 60 KN/m.

26. The extended nip press belt assembly of claim 18, wherein said permeable belt is made of at least one of flexible reinforced polyurethane and a spiral link fabric.

27. The extended nip press belt assembly of claim 26, wherein said permeable belt is made of flexible polyurethane having a plurality of reinforcing yarns embedded therein.

28. The extended nip press belt assembly of claim 27, wherein said plurality of reinforcing yarns include a plurality of machine direction yarns and a plurality of cross direction yarns embedded in said flexible polyurethane.

29. The extended nip press belt assembly of claim 26, wherein said permeable belt is made of flexible polyurethane having a plurality of reinforcing yarns embedded therein, said reinforcing yarns woven in a spiral link manner.

30. The extended nip press belt assembly of claim 26, wherein said permeable belt is a spiral link fabric.

* * * * *